US011440713B2

(12) United States Patent
Canavesio et al.

(10) Patent No.: US 11,440,713 B2
(45) Date of Patent: Sep. 13, 2022

(54) PACKAGE OF A FOOD PRODUCT PROVIDED WITH A SCOOPING TOOL

(71) Applicant: SOREMARTEC S.A., Senningerberg (LU)

(72) Inventors: Diego Canavesio, Carmagnola (IT); Roberta Riva Dogliat, Locana (IT)

(73) Assignee: SOREMARTEC S.A., Senningerberg (LU)

( * ) Notice: Subject to any disclaimer, the term of this patent is extended or adjusted under 35 U.S.C. 154(b) by 0 days.

(21) Appl. No.: 17/124,065

(22) Filed: Dec. 16, 2020

(65) Prior Publication Data

US 2021/0188502 A1 Jun. 24, 2021

(30) Foreign Application Priority Data

Dec. 19, 2019 (EP) ..... 19217891

(51) Int. Cl.

| | |
|---|---|
| ***B65D 51/24*** | (2006.01) |
| ***B65D 77/20*** | (2006.01) |
| ***A47G 21/04*** | (2006.01) |
| ***B65D 77/24*** | (2006.01) |
| ***A47G 21/00*** | (2006.01) |

(52) U.S. Cl.

CPC ..... *B65D 51/246* (2013.01); *A47G 21/04* (2013.01); *B65D 51/247* (2013.01); *B65D 77/2024* (2013.01); *B65D 77/245* (2013.01); *A47G 2021/002* (2013.01)

(58) Field of Classification Search

CPC .. B65D 51/246; B65D 51/247; B65D 77/245; A47G 21/04; A47G 2021/002

See application file for complete search history.

(56) References Cited

U.S. PATENT DOCUMENTS

| | | | | |
|---|---|---|---|---|
| 1,521,768 A * | 1/1925 | Herrmann | ..... | A47G 21/04 30/328 |
| 1,633,605 A * | 6/1927 | Prudden | ..... | B65D 77/2016 229/401 |
| 1,657,325 A | 1/1928 | Suttle | | |

(Continued)

FOREIGN PATENT DOCUMENTS

| | | |
|---|---|---|
| DE | 83 29 004 U1 | 3/1984 |
| DE | 203 1 5 934 U1 | 2/2005 |
| WO | 2009136246 A2 | 11/2009 |

OTHER PUBLICATIONS

European Search Report issued for European Patent Application No. 17217891.1 dated Sep. 9, 2020, 9 pages.

*Primary Examiner* — James N Smalley
*Assistant Examiner* — Jennifer Castriotta
(74) *Attorney, Agent, or Firm* — Rothwell, Figg, Ernst & Manbeck, P.C.

(57) ABSTRACT

Package of a food product comprising a container and a sealing foil connected to the mouth edge of the container and a tool for picking the product, fixed to the surface of the sealing foil, wherein the sealing foil has a surface of thermoplastic plastic material, the tool is a flattened body of cellulosic or wood-cellulosic material, shaped like a spatula, and is fixed to said surface of the sealing foil by ultrasound welding, in the absence of an added adhesive material, along a section of a creasing line generated on the surface of the tool by the sonotrode during the welding process.

17 Claims, 3 Drawing Sheets

(56) References Cited

U.S. PATENT DOCUMENTS

| | | | | |
|---|---|---|---|---|
| 2,598,987 | A * | 6/1952 | Franzen | B65D 77/2016 215/228 |
| 3,931,925 | A * | 1/1976 | Ruff | A47G 21/04 229/125.03 |
| 2008/0110885 | A1* | 5/2008 | Cross | A47G 21/04 220/212.5 |
| 2014/0069933 | A1* | 3/2014 | Cross | A47G 21/06 220/574 |
| 2014/0103675 | A1* | 4/2014 | Cross | G01F 19/002 294/180 |
| 2019/0008299 | A1* | 1/2019 | Goldberg | A47G 21/045 |
| 2020/0130317 | A1* | 4/2020 | Lee | A47G 21/00 |

* cited by examiner

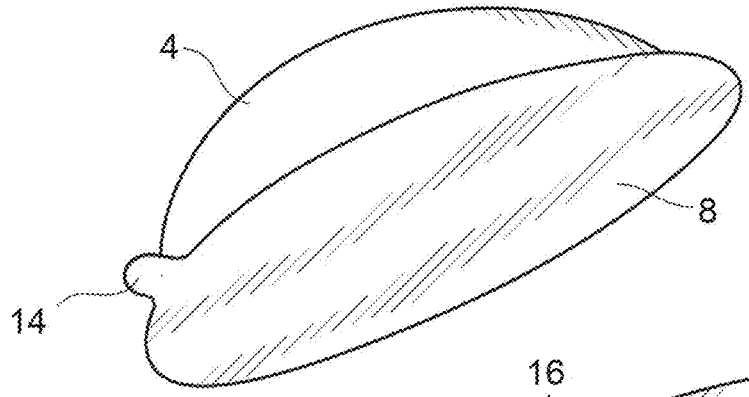
Fig.1
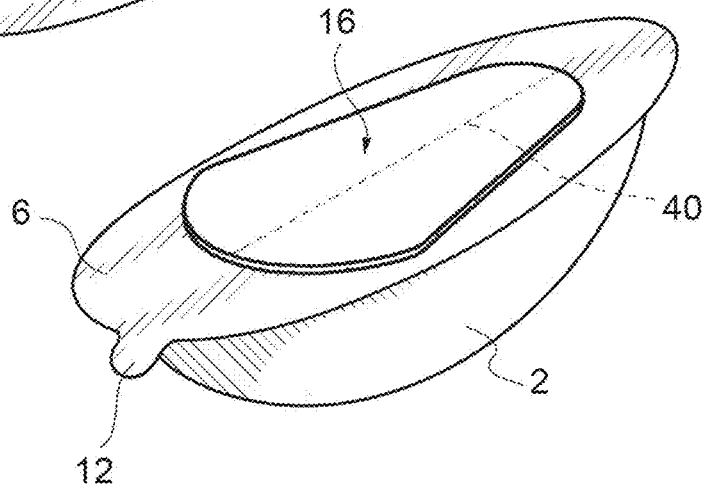
Fig.2
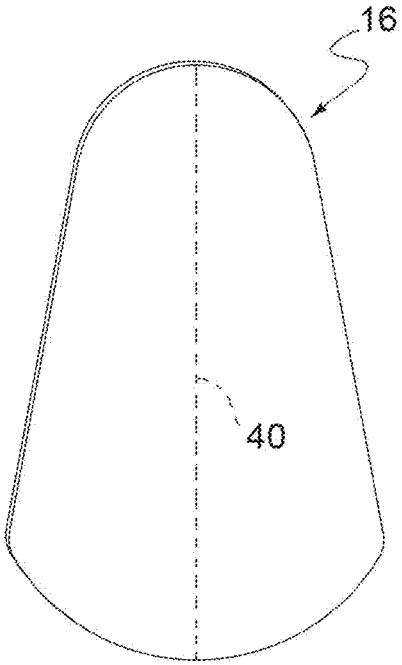
Fig.3
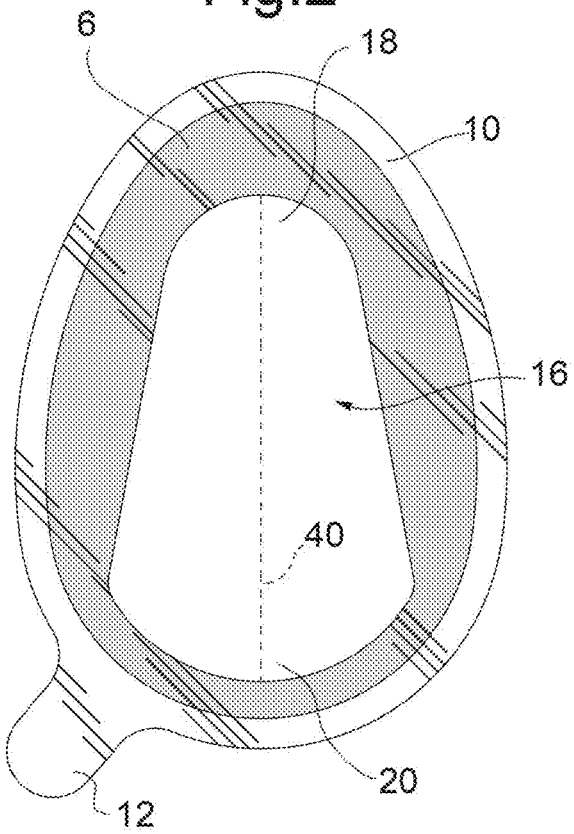

PACKAGE OF A FOOD PRODUCT PROVIDED WITH A SCOOPING TOOL

CROSS REFERENCE TO RELATED APPLICATION(S)

This application claims priority to European Patent Application No. 19217891.1, filed Dec. 19, 2019. The entirety of the disclosure of the above-referenced application is incorporated herein by reference.

The present invention relates to a package of a food product of the type comprising a container for said product, a sealing foil, connected to the mouth edge of the container and a tool for picking the product, fixed to the surface of the sealing foil.

A package of the type mentioned above is, for example, the package relating to the commercial product KINDER JOY®, described in EP 919 488 A1, which comprises two ovoid half-shells of plastic material containing one a food mass and the other an accessory, such as for example, the so-called "surprise" and wherein at least one of the two half-shells is closed like an operculum by a laminar-type diaphragm (sealing foil) fixed to the mouth edge of the half-shell itself; the two half-shells are connected to each other in frontal coupling, so as to form a package with an overall ovoid appearance.

The package described above, in its commercial implementation, includes a plastic scoop or spatula which is fixed to the outer surface of the sealing foil of one of the two half-shells, in particular of the half-shell containing the surprise, so that it can be easily detached from the foil by the consumer and used for picking and/or spreading the food mass.

However, it is understood that the invention also applies to packages comprising a single container closed by a sealing foil.

In view of the environmental need to limit the use of plastic material for the production of disposable articles, it would be desirable to associate a tool of cellulosic material, in particular of cardboard, to the packages of the type mentioned above.

Cardboard tools, shaped like a spatula or shovel, or shaped like a spoon are known and described for example in JPS5473076, JPS5221974U, JPS5212089U, KR 19980043381 U, JPS50107490U, JPS5329589U and DE 202008005709 U1. These tools are presented in the form of a flat blank which, in the case of a conformable tool, has creasing lines, intended to be folded by the user to form a three-dimensional structure with sides, constituting the tool handle and/or a bowl structure, suitable for picking a food mass.

For the purpose of adopting a tool of cellulosic material, taking into account the fact that the sealing foil in the above mentioned packages is generally a sheet or film of plastic material or a laminate whose outer layer is a film of plastic material or even, if necessary, an aluminum film, the different nature of the cellulosic, non-thermoplastic material constituting the tool and of the material used for the outer surface of the sealing foil poses significant problems in order to achieve an optimal connection.

It is in fact necessary that the adhesion force between the foil and the tool is such as to allow easy detachment of the tool even by a child; it is also necessary that the detachment of the tool is not likely to cause a detachment of the foil from the edges of the mouth of the container or possibly a laceration of the foil at the region of adhesion of the tool to the foil.

It is also necessary, for aesthetic and hygienic purposes, that the fibrous surface of the tool, following its detachment, is not abraded and/or torn and does not have residual material deriving from the foil and/or any added adhesive substance.

The present invention has the aim of providing a solution capable of satisfying in an excellent way the needs outlined above, thus providing a package in which the scooping tool is of cellulosic material and which at the same time can be obtained in a simple and cost-effective manner.

SUMMARY OF THE INVENTION

According to the present invention, the above mentioned object is achieved with a package having the features referred to in the following claims.

The invention also relates to the relative manufacturing process, also defined in the following claims.

Another object of the invention is a scooping tool, of cellulosic material, specifically designed for use in the package object of the invention.

Further features and advantages of the invention will become clear from the detailed description which follows, made with reference to the accompanying drawings, provided by way of non-limiting example.

BRIEF DESCRIPTION OF THE DRAWINGS

In the accompanying drawings:

FIG. 1 is a perspective view of a package according to the invention, according to an embodiment in which the package is made up of two half-shell containers each provided with a respective sealing foil, FIG. 2 is a plan view of one of the half-shell containers forming the package of FIG. 1 to which the sealing foil and the respective tool are fixed, FIG. 3 is a perspective view of the scooping tool used in the package of FIG. 1.

DETAILED DESCRIPTION OF THE INVENTION

Figure 4:
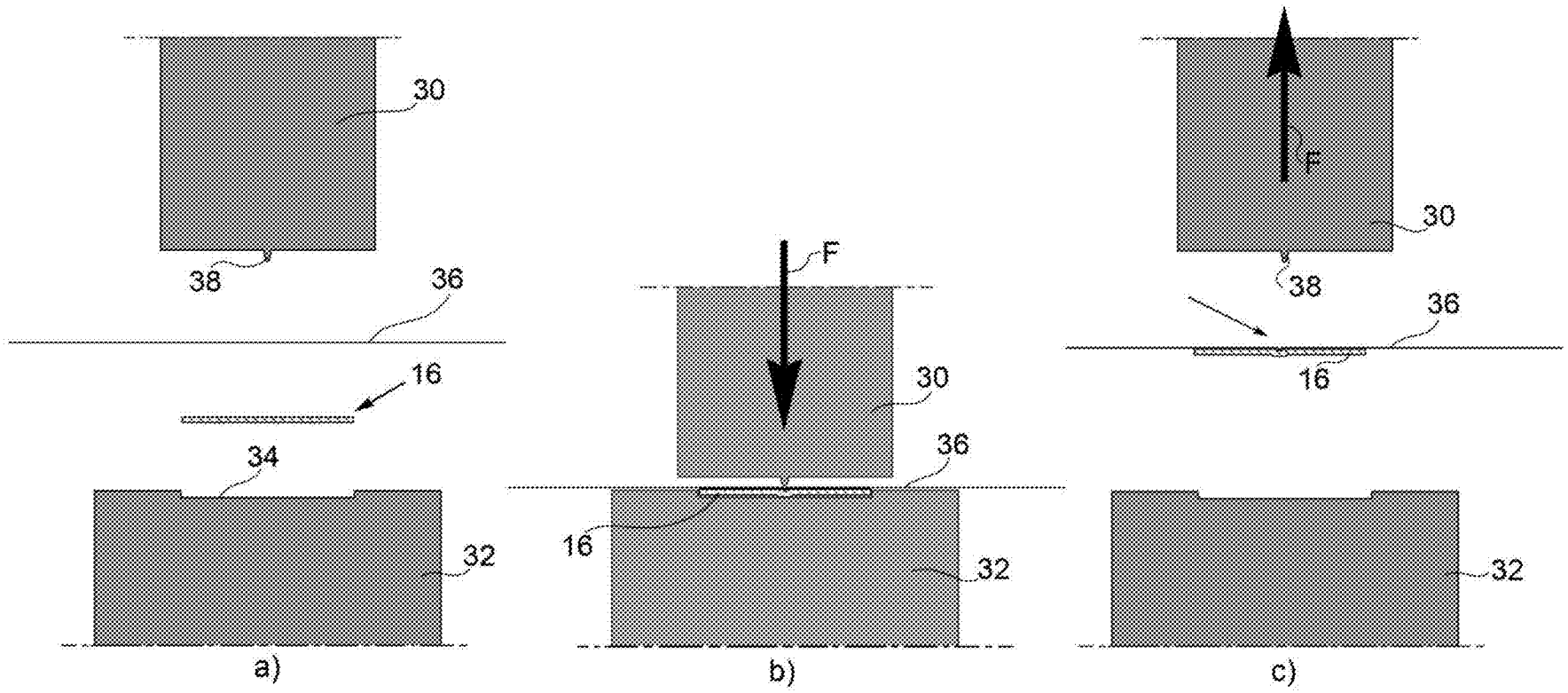
FIG. 4 is a schematic representation illustrating the steps a), b) and c) of the ultrasound welding process for connecting the tool to the sealing foil.

FIG. 1 exemplifies a package according to the invention, having a structure and conformation corresponding to the package described in EP 919 488 A1, the description of which is to be considered incorporated in the present description by reference. Such a package comprises two separate containers, each comprising a respective semi-ovoid half-shell 2, 4 and a respective sealing foil 6 and 8 welded to an annular flange 10 which surrounds the mouth edge of each half-shell; this flange 10 is visible in FIG. 2, in which the sealing foil is illustrated as consisting of a transparent material, to make the underlying flange 10 visible. In each half-shell, the sealing foil has an appendicular formation, 12 and 14, superimposed on a corresponding appendicular formation of the respective flange of the mouth edge (not visible).

The two half-shells, with respective sealing foil, are intended to be connected together by connecting the respective sealing foils at mutually facing surfaces in an area not affected by the appendicular formations.

Reference numeral 16 indicates a scooping tool fixed to the sealing foil 6 of one of the half-shells, in an easily removable manner, intended to be used by the consumer for picking and/or spreading a food mass, contained in the half-shell, following its removal from the foil 6 and following the removal of such a foil from the half-shell.

In general, the scooping tool 16, used according to the invention, is a flattened body, shaped like a spatula or shovel, of cellulosic or wood-cellulosic material, with an end gripping portion 18 intended to be grasped by the user and an end portion 20 for picking the food mass. The term cellulosic or wood-cellulosic includes paper, cardboard, paperboard, wood and the like.

In a preferred embodiment, the tool is a blank of cardboard, obtained from a coupled sheet comprising at least two layers of cardboard 22 and 24 (see section of FIG. 5) glued by means of a thin layer of adhesive 26. These layers are preferably made of virgin cellulosic fiber, suitable for contact with food; the adhesive is preferably a mineral oil-free adhesive for food packaging, also suitable for contact with food (MOSH and MOAH free).

The layers of the laminate can have a weight from 200 to 450 g/m$^2$ and can both have the same weight or different weight. If the layers have the same weight, the tool has a symmetrical structure, for example with two or more layers, for example from 310 g/m$^2$; in the embodiment in which the layers have different weights, the cardboard layer forming the tool which, as better illustrated below, in the welding process faces the sealing foil (hereinafter lower layer), can have a basis weight greater than that of the other layer (upper layer), by way of example from 350 to 400 g/m$^2$ for the lower layer and from 200 to 300 g/m$^2$ for the upper layer. The sealing foil is obtained from a sheet, preferably with a laminated structure, i.e. obtained by the coupling of a plurality of layers, in which at least one surface layer is of thermoplastic material, suitable for ensuring the desired properties as regards the welding of the tool, the welding to the mouth edge of the container, suitability for contact with food and possibly barrier properties.

In a preferred embodiment, the sealing foil has a thermoplastic olefinic polymer or copolymer film as an outer material, i.e. facing the scooping tool, for example of polypropylene, preferably bi-oriented polypropylene (BOPP), for example from 10 to 40 μm, particularly from 15 to 25 μm. Other materials that can be used as the outermost film of the sealing foil include cast polypropylene (CPP) and polyethylene (PE).

With the use of a laminated structure, the material constituting the innermost layer, i.e. facing the food mass, which must have properties suitable for contact with food, as well as properties suitable for thermal or ultrasound welding with the edge of the container, is a polypropylene film, preferably CAST polypropylene (CPP) from 30 to 40 μm. Other materials, the choice of which can be dictated by the nature of the plastic material of which the container is made, include polyethylene (PE) and polyester (PET) films.

The laminated structure may further comprise intermediate layers comprising one or more films of polyester (PET), polypropylene (PP), polyvinyl chloride (PVC). These intermediate layers may optionally be provided with a thin metallization layer. Furthermore, intermediate layers may comprise one or more aluminum films.

According to the invention, the scooping tool 16 is fixed to the sealing foil by means of an ultrasound welding process, without application to the surface of the tool or to the sealing foil of an added adhesive material.

In the schematic representation of the process, illustrated in FIG. 4, reference numeral 30 indicates a sonotrode, capable of being moved vertically, in the direction of the arrow F, by the action of motor means not shown. Reference numeral 32 indicates a support having one or more recesses 34, the perimeter contour of which substantially corresponds to the contour of the scooping tool, indicated with reference numeral 16; the depth of the recess 34 substantially corresponds to the thickness of the tool. Reference numeral 36 indicates a sheet from which, following its welding to the tool, the sealing foil 6 is obtained by cutting. While the schematic illustration refers to the welding of a single tool, it is understood that in industrial practice the process can be carried out using a plurality of sonotrodes and simultaneously applying a plurality of tools to a continuous sheet 36 punched according to a contour corresponding to the contour of the sealing foil.

The active surface of the sonotrode comprises, on its surface facing the support, a rib 38 with a V-section, preferably with a rounded vertex. The rib 38 has a longitudinal extension, preferably straight, corresponding to at least a portion of the longitudinal extension of the tool, preferably corresponding to the entire longitudinal extension of the tool, preferably in the centre line thereof. The rib 38 may extend along a continuous or broken line.

In the operating step b) of FIG. 4, the scooping tool 16 was positioned in the recess 34 with the sheet 36 positioned on the surface of the support covering the tool; the sonotrode 30 is moved vertically, until the rib 38 exerts pressure on the sheet 36 and on the underlying tool 16. Following the application of pressure, the rib 38 creates, on the surface of the tool, a creasing line 40 and the simultaneous application of ultrasound, in the pressing step, generates the welding of the tool to the sheet 36 along such a creasing line 40.

Although the explanation of the phenomenon of adhesion of the tool to the plastic film is not to be understood as binding or limiting the scope of the invention, it is believed that the adhesion is due to the interpenetration between the plastic material and the cellulosic fibers with consequent gripping of materials, generated by mechanical vibration caused by the sonotrode.

The shearing of the sheet 36, according to the desired contour for the sealing foil 6, preferably takes place before ultrasound welding.

Figure 6:
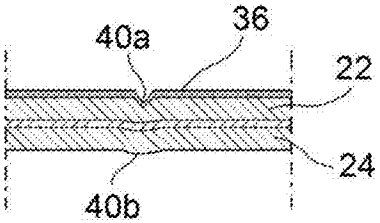
FIG. 6 is a partial section view of the scooping tool to which the sealing foil has been connected.

As illustrated in the section of FIG. 6, following the ultrasound welding operation, the creasing line created on the tool surface is a groove 40*a* with a U-shaped cross section and the sheet 36 is welded to the tool, only at the side walls of the groove.

Preferably, in the embodiment in which the tool consists of a multilayer laminate, the depth of the groove 40*a*, defining the creasing line 40, extends with an extension limited to the thickness of the layer of cellulosic material, facing the sheet 36, in this case the layer 22, so that on the other layer of the laminate (in this case the layer 24) which in the application of FIG. 1 is the outer layer, visible to the consumer, a slightly protruding rib 40*b* is visible; for this reason, in FIG. 1, the creasing line 40 is indicated with a dashed line.

In the embodiment illustrated in FIGS. 2 and 3, the creasing line 40, along which the scooping tool is welded to the sealing foil 6, extends from one end of the tool to the other in substantial coincidence with the its longitudinal axis; however, it is possible to create a creasing line 40 (and the corresponding weld) only for a section, at the end or intermediate, of the tool surface. The creasing line may be a continuous or broken line. For the purpose of welding, the ultrasound generator supplies a sinusoidal electric wave with a frequency, preferably between 15 and 30 kHz, with welding times (time during which pressure is exerted) of the order of 0.1 and 0.3 seconds.

In the preferred embodiment, illustrated in FIGS. 2, 3 and 4, the creasing line 40 extends from one end of the tool to the other.

The creasing line 40, generated in order to achieve the welding of the tool to the sealing foil, following the detachment of the tool from the foil, also constitutes a weakening line which facilitates the folding of the lateral edges of the tool by of the user, to obtain a tool with a concave shape.

It has been found, by means of tool bending tests, that the above creasing line does not cause a significant reduction in the bending strength of the tool under a load orthogonal to the tool plane.

Thus the tool of cellulosic material can be used both in the flat configuration, with the function of a spatula for the collection and/or spreading of a spreadable food product, and in its U-folded configuration along the creasing line, with the main function of a spoon.

Figure 8:
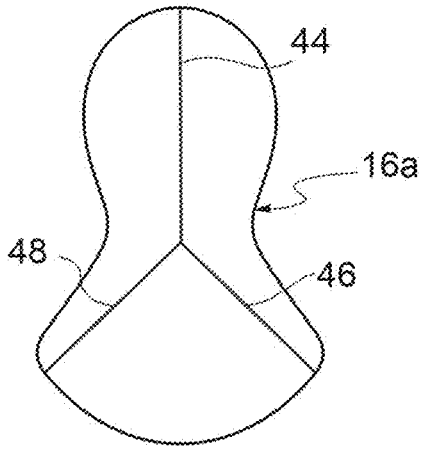
FIG. 8 is a plan view of a further embodiment of the scooping tool.

In an alternative embodiment, illustrated in FIG. 8, the tool, indicated with 16*a*, is intended to be welded to the sealing foil along the creasing line 44, which extends along a portion of the longitudinal axis, and also has two further creasing lines 48 and 46, which branch off from the line 44, possibly not welded to the sealing foil.

Figure 9:
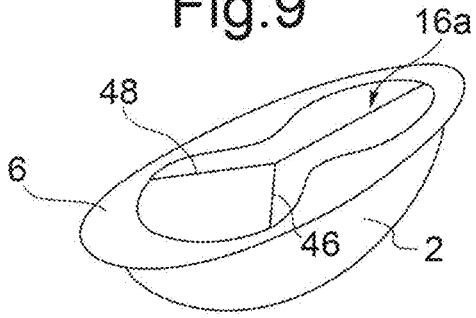
FIGS. 9 and 10 are perspective views of a package according to the invention, to which the tool of FIG. 8 is associated and, respectively, of the tool detachment operation, carried out by the consumer.
Figure 10:
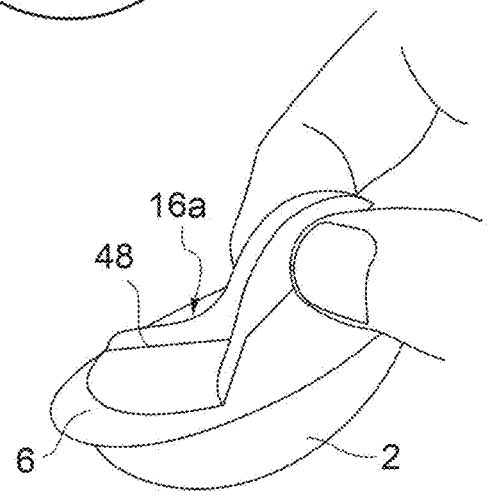

The creasing lines 48 and 46, if not welded to the foil, can be made in the blank during its cutting, before welding to the foil. The tool of FIG. 8 can be folded along the lines 44, 46 and 48 to obtain a tool as represented in FIG. 9, of three-dimensional shape as indicated in FIG. 10.

EMBODIMENT EXAMPLE

Figure 5:
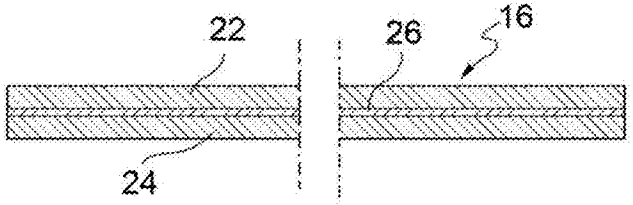
FIG. 5 is a partial section view of the scooping tool before welding.
Figure 7:
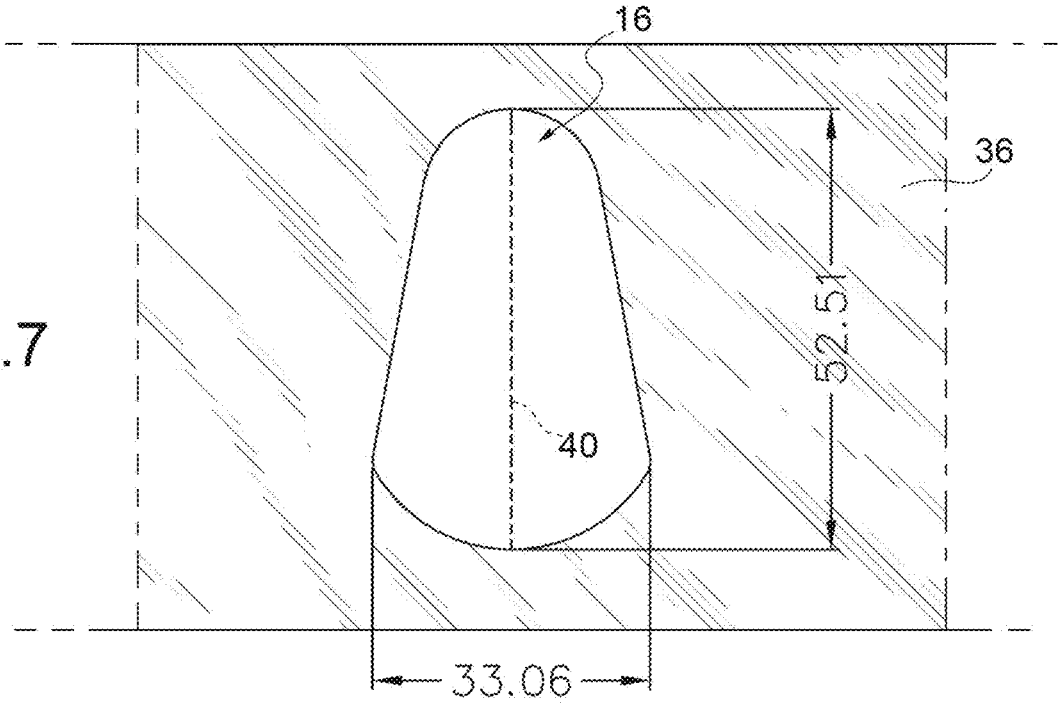
FIG. 7 is a plan view of the scooping tool associated with a sheet intended to constitute the sealing foil.

A cardboard scooping tool was created with the shape and dimensions shown in FIG. 7. A two-layer laminated cardboard with section was used, as shown in FIG. 5, comprising:

- a first layer of virgin cellulosic fiber of 390 g/m$^2$ (layer intended to be turned and welded to the sealing foil),
- a layer of adhesive (RESICOL product C239, 0.03 g/tool), and
- a 230 g/m$^2$ layer of virgin cellulosic fiber (layer intended to face outwards).

Following the cutting of the tool (to obtain a blank without creasing lines) the tool thus obtained was welded to a sheet intended to constitute the sealing foil comprising:

- a 20 μm BOPP film (film to which the tool is welded)
- a layer of adhesive
- a layer formed by a combination of 12 μm PET and 15 μm or 20 μm BOPP
- printing inks
- adhesive
- a 40 μm or 30 μm CPP film.

The ultrasound welding of the tool to the sheet was carried out with a sonotrode, as schematically described in FIG. 4, with the application of a frequency of 20 kHz and carrying out the welding along a creasing line thus generated, extending from one end to the other of the tool (1=52.51 mm).

Following repeated tests, the tool is easily detachable from the sealing foil, but fixed sufficiently firmly to avoid risks of accidental removal.

Bending tests were carried out on the tool detached from the sealing foil in comparison with bending tests relating to a tool having the same conformation, dimensions and structure, but without the creasing line 40.

For the bending tests, the rigidity meter (L&W Bending Tester) was used, positioning the tool with the creasing line (when present) against the load cell and the widest part in the clamp and thus activating the bending; the clamp rotates, bringing the tool into contact with the load cell. The tool exerts pressure against the cell and the force is measured with respect to different angle degrees: 0-5°; 0-7.5°; 0-15° and 0-30° C.

The values measured and reported in the following table are the average of 10 measurements.

| Bending measures | | | | |
|---|---|---|---|---|
| | Angulation | | | |
| | 0-5° | 0-7.5° | 0-15° | 0-30° |
| | Unit of measurement | | | |
| | mN | mN | mN | mN |
| Tool with creasing | 2284 | 3151 | 3954 | 4130 |
| Tool without creasing | 2536 | 3520 | 4287 | 4497 |

The results indicate a reduced decrease in the bending strength caused by the presence of the creasing line.

The invention claimed is:

1. A package of a food product comprising a container (2) and a sealing foil (6) connected to the mouth edge of the container and a scooping tool (16) for picking up the product, fixed to the surface of the sealing foil, characterized in that:

the sealing foil (6) has a plastic surface, the scooping tool (16) has a flattened body of cellulosic or wood-cellulosic material and is fixed to said surface of the sealing foil by ultrasound welding, in the absence of an added adhesive material.

2. The package according to claim 1, characterized in that said scooping tool (16) is fixed to the outer surface of the sealing foil along at least a section of a continuous or broken creasing line (40) generated on the surface of the scooping tool facing towards said foil, during the welding process.

3. The package according to claim 2, characterized in that said creasing line (40) extends longitudinally from one end of the flattened body of the scooping tool to the other.

4. The package according to claim 1, characterized in that said scooping tool is a blank of cardboard, obtained from a sheet of coupled cardboard comprising a first (22) and a second (24) layer of cardboard connected one to the other by means of an adhesive.

5. The package according to claim 4, characterized in that said first and second layers each have a weight from 200 to 450 g/m$^2$.

6. The package according to claim 4, characterized in that said first layer (22), intended to face the sealing foil, has a basis weight from 350 to 400 g/m$^2$ and said second layer has a basis weight from 200 to 300 g/m$^2$, the weight of said first layer being greater than the weight of the second layer.

7. The package according to claim 4 wherein said scooping tool has a continuous or broken creasing line at its longitudinal axis, said creasing line being in the shape of a groove with a depth not exceeding the thickness of said first layer (22).

8. The package according to claim 1, characterized in that said sealing foil (6) has a laminated structure comprising, on the side facing the scooping tool, at least one thermoplastic olefinic polymer or copolymer film.

9. The package according to claim 8, wherein the at least one thermoplastic olefinic polymer or copolymer film on the side facing the scooping tool is comprised of polypropylene.

10. The package according to claim 8, wherein the at least one thermoplastic olefinic polymer or copolymer film on the side facing the scooping tool is comprised of bi-oriented polypropylene.

11. The package according to claim 8, characterized in that said sealing foil further comprises one or more intermediate films of polyester or polypropylene, and a surface film of cast polypropylene, facing the container.

12. The package according to claim 11, characterized in that the one or more intermediate films of polyester or polypropylene of said sealing foil is metallized.

13. A method for the production of a package according to claim 1, characterized in that it comprises the operation of welding said scooping tool (16) to the sealing foil (6) by means of ultrasound welding.

14. The method according to claim 13, characterized in that the ultrasound welding operation is carried out by generating, simultaneously with the welding, in the body of the scooping tool, a continuous or broken creasing line which extends longitudinally along at least a section of the longitudinal extension of the scooping tool and along which the tool is connected to the sealing foil.

15. The method according to claim 14, characterized in that the welding operation is carried out by arranging a sheet intended to form the sealing foil superimposed on the scooping tool, said sheet having a surface facing the scooping tool formed by a film of thermoplastic material, and wherein the ultrasound welding operation is carried out with the use of a sonotrode (30), the active surface whereof includes a rib (38) with a V-section which is capable of generating, following compression exerted on the sheet superimposed on the scooping tool, said creasing line (40) in the tool body.

16. The method according to claim 13, characterized in that the ultrasound welding operation is carried out with a frequency of 15 to 30 kHz.

17. A scooping tool formed by a blank of cardboard, obtained from a sheet of coupled cardboard comprising at least a first (22) and a second (24) layer, glued together by means of an adhesive and having a creasing line which extends from an end to the other of the blank, at its longitudinal axis, wherein said creasing line is a groove having a depth not exceeding the thickness of said first layer (22).

* * * * *